US005117760A

United States Patent [19]

Almaraz et al.

[11] Patent Number: 5,117,760

[45] Date of Patent: Jun. 2, 1992

[54] RAIL ANCHOR SPREADER WITH RAIL CLAMP AND ADJUSTABLE HEAD ASSEMBLY

[75] Inventors: Roberto Almaraz, Racine; Jeffrey S. Hon, Waterford; Thomas F. Petrykowski, Racine; Ronald L. Rhodes, Racine; Robert L. Turner, Racine, all of Wis.

[73] Assignee: Racine Railroad Products, Inc., Racine, Wis.

[21] Appl. No.: 573,460

[22] Filed: Aug. 27, 1990

[51] Int. Cl.[5] ..... E01B 29/32

[52] U.S. Cl. ..... 104/2; 104/9; 104/17.2

[58] Field of Search ..... 104/2, 9, 7.1, 17.2, 104/307

[56] References Cited

U.S. PATENT DOCUMENTS

| | | | |
|---|---|---|---|
| 989,933 | 4/1911 | Smith | 104/2 |
| 3,117,531 | 1/1964 | Miller | 104/17.2 |
| 3,438,335 | 4/1969 | McIlrath | 104/17.2 |
| 4,068,593 | 1/1978 | Leeves | 104/17.2 X |
| 4,580,501 | 4/1986 | Collins et al. | 104/307 |
| 4,809,614 | 3/1989 | Theurer et al. | 104/9 X |
| 4,890,558 | 1/1990 | Quella et al. | 104/17.2 X |
| 4,903,611 | 2/1990 | Holley | 104/9 X |

OTHER PUBLICATIONS

The Holly Engineering Co., Inc. brochure entitled "Anchor Squeezer".

*Primary Examiner*—Robert J. Oberleitner
*Assistant Examiner*—S. Joseph Morano
*Attorney, Agent, or Firm*—Wood, Phillips, Mason, Recktenwald & Van Santen

[57] ABSTRACT

An anchor spreader having a frame which mounts a head assembly for vertical movement between a raised travel position and a lowered operative position, with the head assembly having spreader members which can be positioned adjacent a tie and inwardly a pair of rail-mounted anchors. The spreader members can be moved apart to shift the rail-mounted anchors along the rail away from the tie to spread the anchors. A positive clamp mechanism securely holds the head assembly in position longitudinally of the rail whereby the head assembly can remain in fixed position regardless of the reaction to forces exerted in spreading one or more anchors.

21 Claims, 5 Drawing Sheets

RAIL ANCHOR SPREADER WITH RAIL CLAMP AND ADJUSTABLE HEAD ASSEMBLY

FIELD OF THE INVENTION

This invention relates to an anchor spreader for spreading rail-mounted anchors whereby rail-mounted anchors may be moved away from a tie, while still mounted to a rail, to enable tie removal and replacement.

BACKGROUND OF THE INVENTION

A rail anchor clamps onto a rail and is positioned to abut a vertical face of a tie whereby there is resistance to longitudinal movement of the rail relative to the supporting tie.

For many years, there have been machines for setting and applying rail anchors. This type of equipment is shown in Quella Patent No. 4,890,558 and Miller Patents Nos. 3,117,530 and 3,132,597. Additional equipment of this type is shown in McIlrath Patents Nos. 3,272,148 and 3,438,335. Equipment for applying a clip, rather than an anchor, is shown in McIlrath Patent No. 4,320,707.

The foregoing equipment result in placing rail-mounted anchors in close abutting relation with opposite vertical faces of a tie. When a tie is to be replaced, it is necessary to shift the tie-abutting, rail-mounted anchors lengthwise of the rail to positions away from the tie, so that a tie remover can longitudinally withdraw the tie from beneath the rail, followed by tie replacement and return of the rail-mounted anchors to tie-abutting positions. This return of the anchors to tie-abutting positions could be accomplished by use of a rail anchor relocator, such as shown in the Miller Patent No. 3,117,531.

In spreading a pair of anchors along a rail, the forces required to spread each anchor may not necessarily be equal and opposite, which could result in an imbalance of forces tending to move the anchor spreader, itself, longitudinally of the rail. If the anchor spreader is operating against only a single anchor, an even greater force imbalance is created. Therefore, it is desirable for the spreader to have the capability of fixedly engaging the rails prior to spreading the anchors. In this way the reaction force is transmitted to the rails and the spreader is not shifted It also is critical, however, to avoid damaging or deforming the rail when clamping Rail deformation produces local stress risers in the rail which would eventually lead to catastrophic failure under the extreme loadings to which they are exposed. Prior spreader devices, though successful for many years, do not disclose such a damage-free rail engaging capability.

SUMMARY OF THE INVENTION

An object of the present invention is to provide an improved rail anchor spreader for spreading one or more rail-mounted anchors away from a tie.

In the exemplary embodiment of the invention, the anchor spreader has a head assembly movably mounted on a frame, with a hydraulic cylinder interposed between the frame and the head assembly for driving the head assembly vertically toward and away from a tie. Spreader bars are movably mounted on the head assembly for engaging a pair of rail-mounted anchors and moving the anchors oppositely along the rail away from the tie to spread the anchors.

The head assembly includes a pair of spaced-apart, rigidly connected header plates. The spreader bars extend vertically between the header plates and each has an interchangeable anchor-engaging spreader plate at the lower end thereof A plurality of hydraulic cylinders movably connect a spreader bar to a header plate whereby the hydraulic cylinders can move the spreader bars toward the header plate and the spreader plates away from positions adjacent the tie to spread the anchors.

The anchor spreader also includes rail clamping structure for releasably clamping the rail to hold the head assembly against movement longitudinally of the rail during spreading of the anchors. The clamping structure includes a pair of spaced-apart clamp assemblies mounted on the head assembly, each clamp assembly having a plurality of vertically depending hydraulic cylinders pivotally interconnecting the head assembly at one end and a rotatable clamp at an opposite end, whereby activation of the hydraulic cylinders rotates the clamps into engagement with a rail.

Also provided on a rail clamp assembly is an elongate friction pad disposed in underlying relation with the assembly for applying a frictional resistance force to the top face of a rail. The friction pad has an arcuate recess for fully engaging the upper portion of a rail when the head assembly is lowered. Adjustment means are provided to enable the selective positioning of the clamp assembly on the head assembly. The position of the rail-engaging friction pad relative to the head assembly is thereby prescribed for setting the lowered position of the head assembly due to variations in the height of rail with which the anchor spreader is used.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

Figure 2:
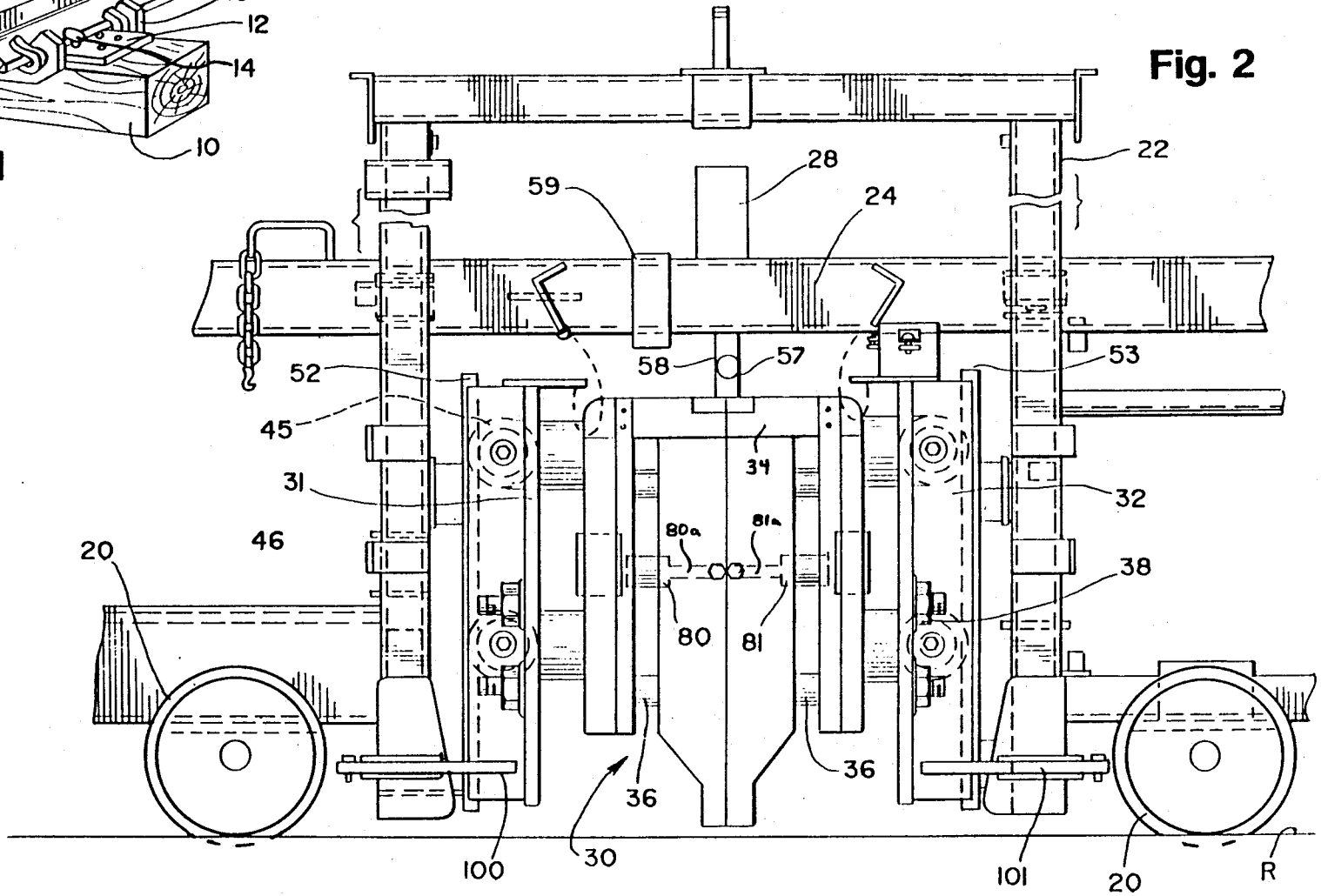
FIG. 2 is a fragmentary side elevational view of the anchor spreader of the invention, with the head assembly in raised position to enable travel along a railroad track.
Figure 5:
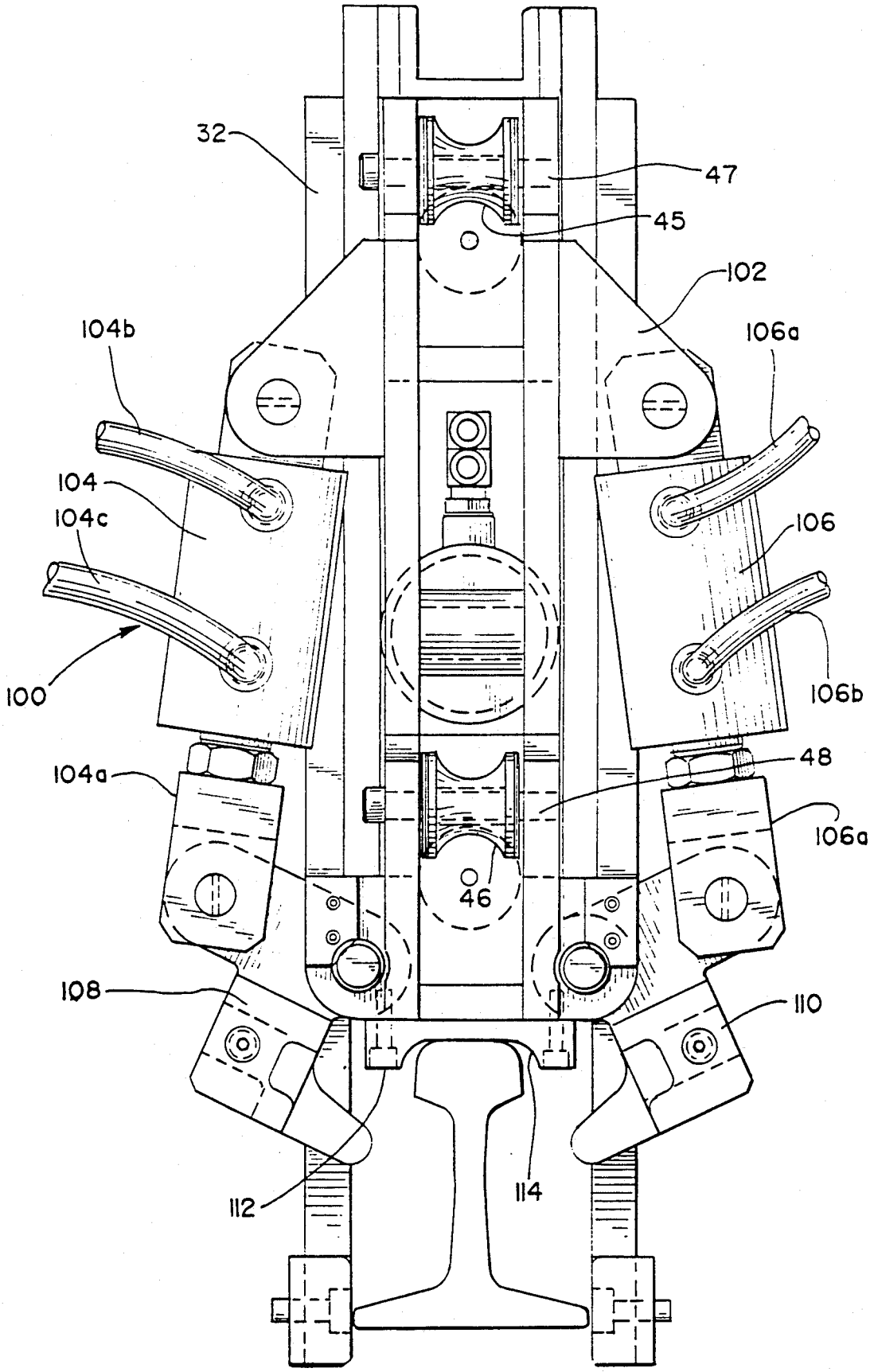

FIG. **4*a* is a fragmentary side elevational view of the anchor spreader showing a position of the structure shown in FIG. 2** on a lowered operative position and with the spreader plates and rail anchor in a spaced apart position;

FIG. 5 is a fragmentary end elevation of a part of rail clamping structure on the spreader shown in FIG. 2.

DETAILED DESCRIPTION OF THE PREFERRED EMBODIMENT

Figure 1:
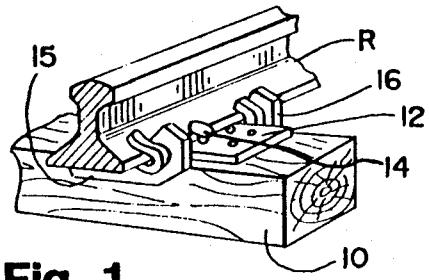
FIG. 1 is a fragmentary perspective view showing a rail, a tie, a pair of rail anchors and associated structure.
Figure 3:
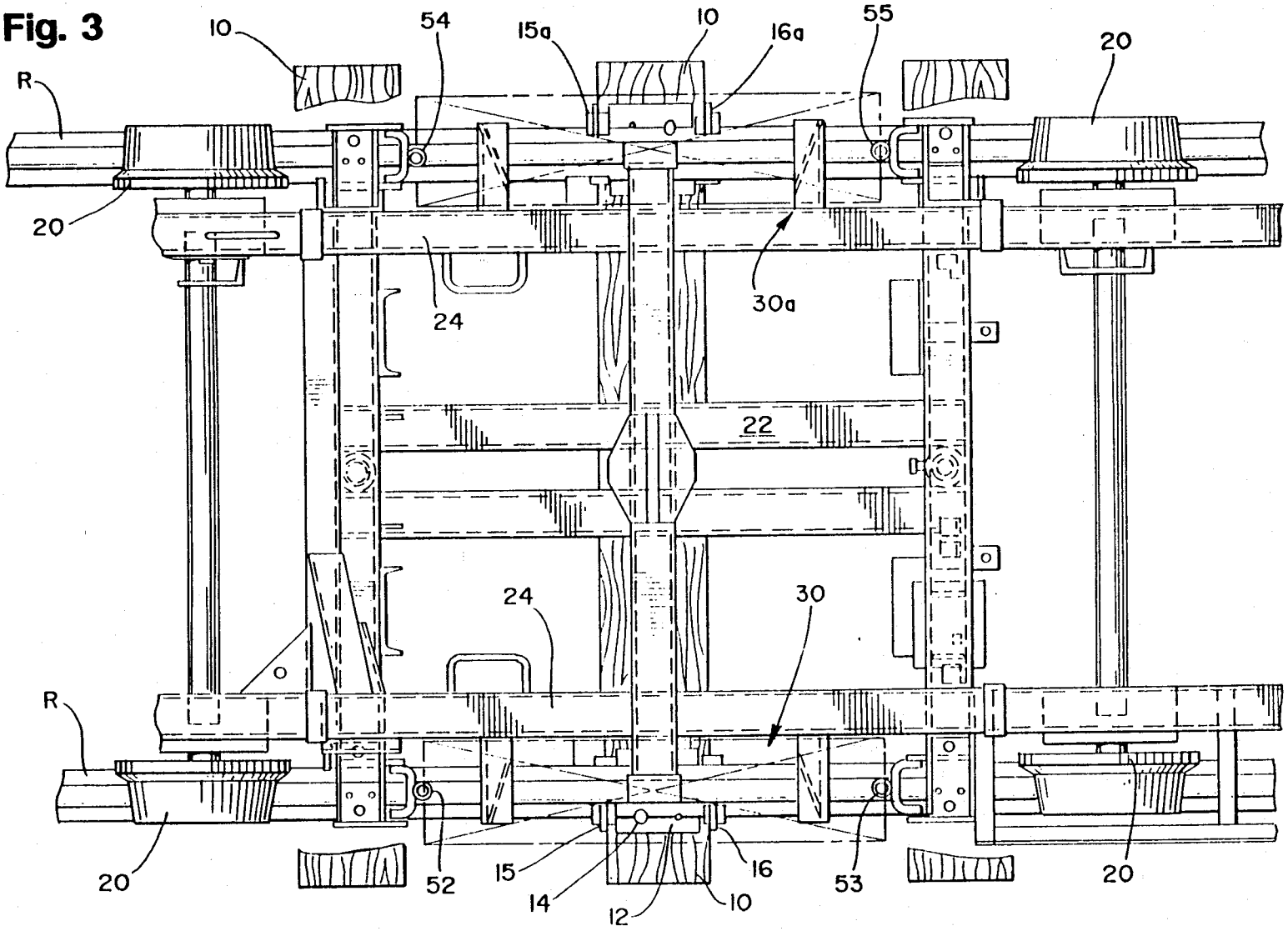
FIG. 3 is a fragmentary plan view of the vehicle frame structure shown in FIG. 2, with the frame positioned to provide for spreading of two pairs of rail-mounted anchors adjacent opposite ends of a tie.

Several of the drawing figures show railroad track structure including a rail, a tie and associated structure including a tie plate and rail-mounted anchors. As seen in FIGS. 1 and 3, a tie 10 has a tie plate 12 secured thereto by a rail spike 14. A rail R is mounted on the tie plate, and a pair of rail-mounted anchors 15 and 16 abut opposite sides of the tie. As seen in FIG. 3, there usually is similar associated structure adjacent the opposite end of the tie, including a tie plate 12*a* and rail anchors 15*a* and 16*a*. A series of ties 10 spaced lengthwise of the rail R each can have the structure as described in connection with FIG. 1.

The function of the anchor spreader is to spread anchors 15 and 16 from the tie-abutting position shown in FIGS. 1 and 3 to a spread position at a distance from opposite sides of the tie 10. This frees the tie 10 for lengthwise removal from the ballast 18 preparatory to tie replacement.

The anchor spreader, as seen in FIGS. 2–4*a*, has a vehicle chassis rotatably mounting rail-engaging wheels 20 for lengthwise positioning of the anchor spreader along the track. The spreader has an upright frame 22 with a pair of intermediate height frame members 24 each mounting a head lift cylinder 28.

Figure 4:
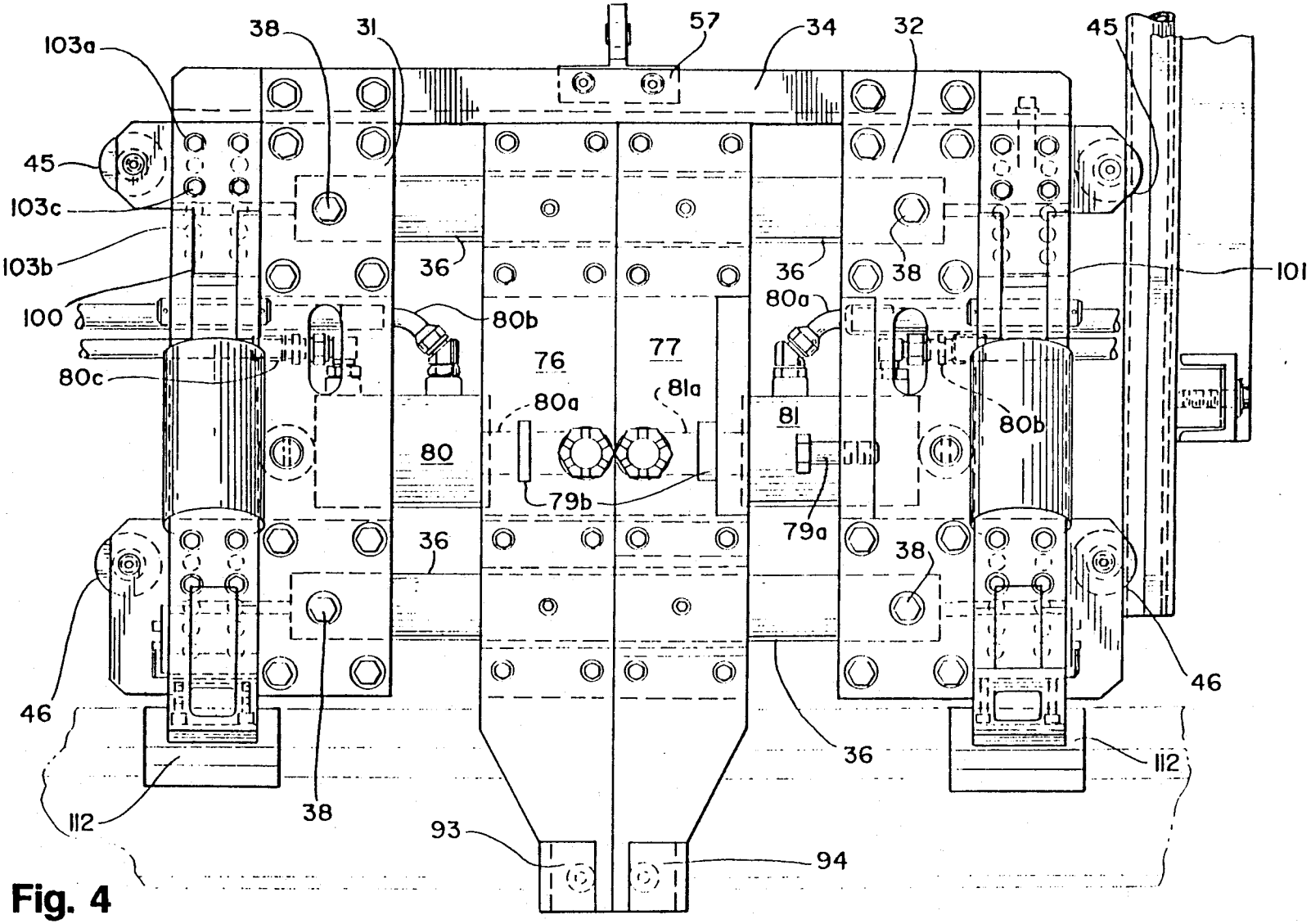
FIG. 4 is a fragmentary side elevational view of the anchor spreader showing a position of the structure shown in FIG. 2, on an enlarged scale, and with the spreader plates in adjacent position.
Figure 4A:
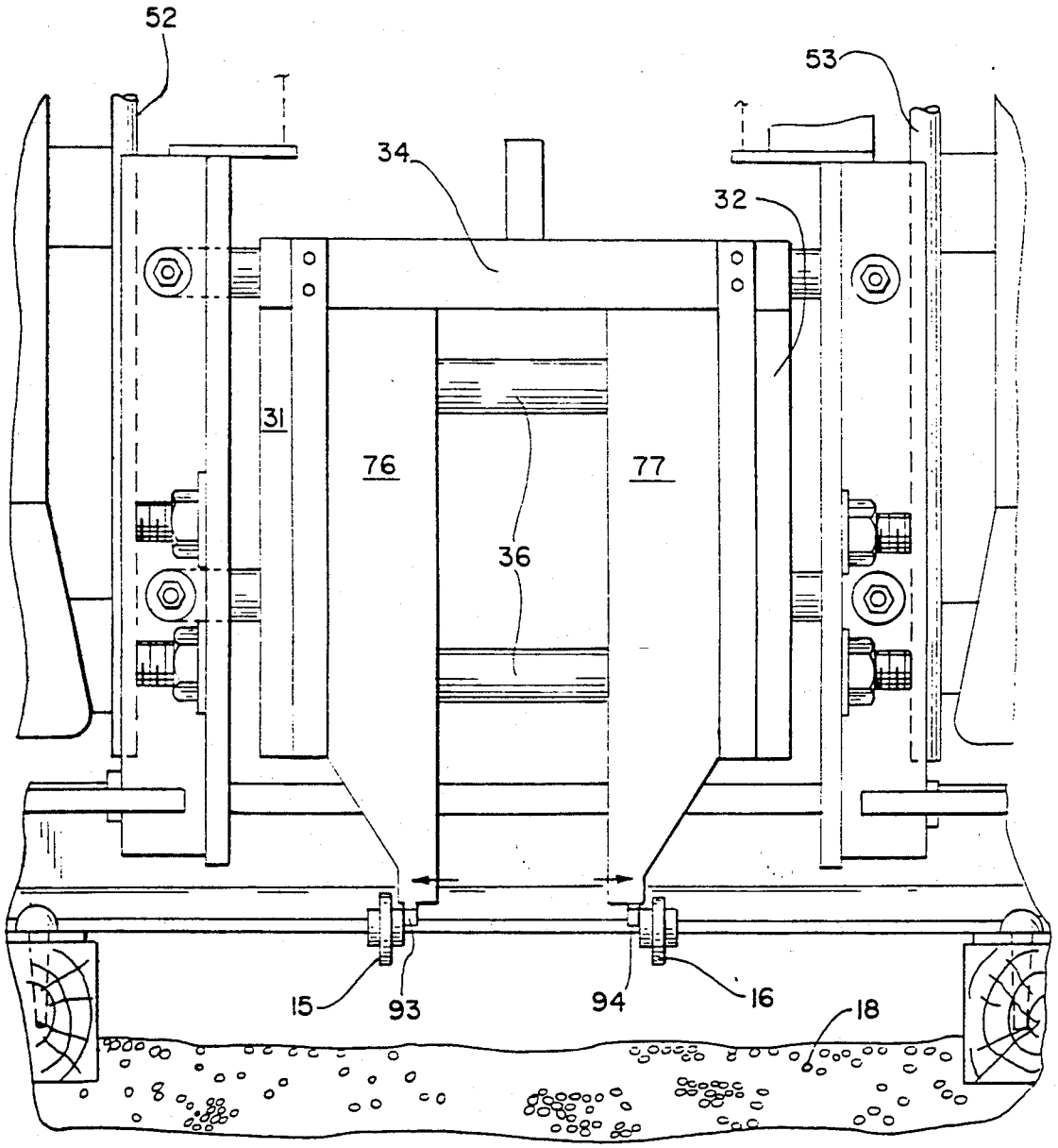

A head assembly, indicated generally at 30, is movably supported on the frame for vertical movement between a raised travel position, shown in FIG. 2, and a lowered operative position, shown in FIG. 4*a*. Referring to FIG. 4, the head assembly has a pair of spaced-apart header plates 31 and 32 depending vertically from an overhead cross brace 34. Header plates 31 and 32 are rigidly interconnected to each other by means of a pair of horizontally disposed header rods 36 which extend through openings in these components and have fixed ends which receive bolts 38.

Header plates 31 and 32 are of the same construction, with the header plate 32 shown particularly in FIG. 5. A pair of guide rollers are rotatably mounted on each header plate at vertically-spaced locations including upper guide rollers 45 and lower guide rollers 46 mounted on respective shafts 47 and 48.

The guide rollers 45 and 46 coact with fixed guide rods 52 and 53 (FIG. 3) extending vertically along the corner frame members of the chassis.

In order to spread the anchors adjacent both ends of the tie, the vehicle has two of the head assemblies with a second head assembly indicated generally at 30*a* in FIG. 3. Head assembly 30*a* is identical to head assembly 30 which is described herein in detail. Head assembly 30*a* would have the guide rollers movable along the guide rods 54 and 55 (FIG. 3) supported by two of the corner frame members.

Cylinder 28 has a rod 58 connected to a bracket 57 secured to cross brace 34 whereby the head assembly may be moved vertically between the travel position shown in FIG. 2 and a lowered operative position. It is necessary to have the capability to forcefully power the head assembly downwardly in the event that the spreading tools described below encounter densely packed rail ballast before fully engaging the rail-mounted anchors. Under the power of cylinder 28, the spreading tools described can penetrate the ballast and move to a desired position.

A limit switch 59 (see FIG. 3) is mounted on intermediate height frame member 24 and is operative to detect the position of head assembly supported thereunder. By sensing the position of the head assembly during the raising and lowering thereof, the requirement of fully retracting cylinder 28 prior to moving the vehicle along the rails to a next tie is obviated. Instead, the head assembly need only be raised to a height sufficient to clear the tie over which the adjuster is instantly positioned. Once the predetermined sufficient height is detected by limit switch 59, electric circuit means (not shown) act to cease retraction of cylinder 28. By eliminating the need to fully retract lift cylinder 28, the spreading process is significantly expedited.

The head assembly further includes a pair of spreader bars 76 and 77 which are movable on the head rods 36 whereby the spreader bars can move from their adjacent position, shown in FIGS. 2 and 4, to a spaced apart position. This movement between the two positions is achieved by operation of a pair of hydraulic cylinders 80 and 81 located on head assembly 30. As seen in FIGS. 2 and 4, cylinders 80 and 81 have colinear piston rods 80*a* and 81*a* secured at one end to the spreader bars 76 and 77, respectively, and the barrels of the cylinders 80 and 81 are secured to the lower ends of header plates 31 and 32, respectively. By controlling hydraulic fluid through the cylinder line 80*b* and 80*c*, the spreader bars are caused to move toward and away from the each other.

Each of the spreader bars 76 and 77 has a provision for mounting spreader plates (tool plates) 93 and 94, respectively, which can have the necessary shape to coact with the rail anchors 15 and 16 and which exert force thereupon to move the anchors from the position shown in FIG. 3 to the spaced apart position shown in FIG. 4*a*.

Spreader bar travel limits are illustrated in FIG. 4 and comprise bolts 79 (shown only in connection with head plate 32) threadedly engaged with corresponding head plates 31 and 32 Complementary upstanding stops 79*b* are mounted on the outer edges of spreader bars 76 and 77 and engage the heads of bolts 79 when the bars are driven apart and to limit the travel thereof. By varying the degree to which bolts 79 engage the head plates, the position of the bolt heads and thereof the position of the travel limits is prescribed.

The head assembly further includes releasable rail-clamping means for clamping a rail in two spaced-apart locations which are effective to hold the head assembly against movement longitudinally of a rail during the anchor spreading operation The forces required to spread the anchors 15 and 16 may not necessarily be equal and opposite, which could result in an imbalance of forces tending to move the anchor spreader, itself, longitudinally of the rail. If the anchor spreader is operating against only a single anchor, the rail clamping means must hold the anchor spreader in position on the rail against reaction to the spreading force.

The rail clamping means include a pair of identical assemblies 100 and 101 mounted on the header plates 31 and 32 and with the assembly 100 and associated structure being shown particularly in FIG. 5. The clamp assemblies are adjustably fixed to corresponding header plates by means of a series of vertically spaced apertures 103*a* on the clamp assemblies and complementary apertures 103*b* on the header plates (FIG. 4). Apertures 103*a* and 103*b* are aligned with the clamp assemblies in a preferred relationship with the head assembly and secured by adjusting bolts 103*c*.

As illustrated in FIG. 5, clamp assembly 100 includes a mounting flange 102 projecting forwardly and rearwardly from header plate 32 and rotatably supports the barrel end of a pair of hydraulic cylinders 104 and 106. Cylinder rods 104*a* and 106*a* depend substantially vertically from the respective cylinders and pivotally engage a pair of rotatable clamp boots 108 and 110, respectively, pivoted to a lower end of the header plate. By the control of hydraulic fluid through cylinder lines, the clamp boots are caused to counter rotate and fixedly engage the rail to apply a frictional resistance force to the lateral faces thereof.

Additionally, a pair of elongate friction pads 112 are mounted in underlying relation on the rail clamp assemblies 100, 101 and each has an arcuate recess 114 for frictionally engaging the upper portion of a rail when the head assembly is lowered In addition to the gripping force of clamp boots 108 and 110, therefore, lengthwise movement of the apparatus along the rails is resisted by the engagement of the friction pads with the top face of the rail.

Because rails of varying height are used, the anchor spreader must have means for adjusting the lowered position of the head assembly 30 relative to the frame in order to assure that the lowered position of the head assembly has operative components thereof positioned immediately adjacent the anchors regardless of rail height. With the clamp assemblies adjusted in a preferred relationship to the head plates, descent of the head assembly is limited by the engagement of the friction pads with the rail, and the height of the operative position of the head assembly can therefore be adjusted with the use of adjusting apertures 103*a*, 103*b* and adjusting bolts 103*c*.

Operation of the anchor spreader may be briefly summarized as follows. The anchor spreader is brought to a desired location along the rails to have the head assemblies overlie a tie. With the spreader bars adjacently positioned and cylinders 80 and 81 in an extended position, a head assembly is driven from the travel position to the operative position, as established by the engagement of the friction pads 112 with the rail. As prescribed by the relative position of the clamp assemblies, the spreader plates are aligned with portions of the rail anchors extending above the ties. If the amount of engageable anchor surface extending above the rail base is insufficient to spread the anchor without damaging the tie or the anchor, the tie must be removed prior to spreading the anchors. In that situation, the clamp assemblies are adjusted to a lower position relative to the header plates so that the lowered spreader plates extend into the void created by the removed tie and more fully engage the anchors. It is in this scenario that the forceful lowering of the head assembly under the power of hydraulic cylinder 28 is advantageous to penetrate the railway ballast with the spreader plates.

The first action in the spreading sequence is the actuation of the rail clamping means by operation of cylinders 104 and 106 and, after the rail is clamped, cylinders 80 and 81 are operated to spread the spreader bars 76 and 77 whereby the spreader plates 93 and 94 move the rail-mounted anchors 15 and 16 away from the position shown in FIG. 3 to a spaced apart position. Deactivation of an operator's switch (not shown) causes retraction of the spreader bars and release of the rail clamping means. The head assemblies then can be elevated whereby the anchor spreader can be advanced to the next tie having rail-mounted anchors that are to be spread.

From the foregoing description, it will be evident that the anchor spreader enables the spreading of rail-mounted anchors to a distance away from a tie whereby the tie can be removed for replacement, with the anchor spreader having the versatility to spread anchors mounted on rails that may vary in height at various locations and to operate effectively when there is an anchor present only at one side of a tie.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An anchor spreader for moving one or more rail-mounted anchors along a rail, comprising:

a frame;

a head assembly movably mounted on the frame;

actuator means interposed between the frame and the head assembly for moving the head assembly toward and away from the rail;

spreader means mounted on the head assembly and movable between a raised inoperative position and a lowered operative position, the spreader means including spreader plates extending beyond the bottom surface of the rail in the lowered operative position of the spreader means for engaging a pair of rail-mounted anchors and moving the anchors oppositely along the rail to spread the anchors.

2. An anchor spreader as defined in claim 1 including releasable means on said head assembly for clamping the rail to hold the head assembly against movement longitudinally of the rail during spreading of the anchors.

3. An anchor spreader as defined in claim 1 wherein said head assembly has a pair of spaced-apart header plates rigidly connected thereto, said spreader means including a pair of vertically-extending spreader bars positioned between said header plates and each having one of said anchor-engaging spreader plates at the lower end thereof.

4. An anchor spreader as defined in claim 3 wherein said head assembly has a hydraulic cylinder movably connecting each spreader bar to the respective header plate whereby the hydraulic cylinders can move the spreader bars toward the header plates and the spreader plates to spread the anchors.

5. An anchor spreader as defined in claim 1 including means for releasably clamping the rail to hold the head assembly against movement longitudinally of the rail during spreading of the anchors, said releasable clamp means being adjustably mounted on the head assembly relative to the spreader plates for setting said lowered operative position of the head assembly to accommodate variations in the height of rails with which the anchor spreader is used.

6. An anchor spreader as defined in claim 5 in which the actuator means interposed between the frame and the head assembly for driving the head assembly vertically toward and away from a tie comprises a hydraulic cylinder.

7. An anchor spreader for spreading one or more anchors along an underlying rail, comprising:

a frame;

a head assembly moving mounted on the frame between a raised inoperative position and a lowered operative position;

spreader means movably mounted on the head assembly for engaging a pair of rail-mounted anchors and moving the anchors oppositely along the rail; and rail clamping means adjustably mounted on the head assembly for releasably clamping the rail to hold the head assembly against movement longitudinally of the rail during spreading of the anchors, said rail clamping means being engageable with the underlying rail for setting the lowered operative position of the head assembly, said clamping means comprising a pair of spaced apart clamp assemblies mounted on said head assembly.

8. An anchor spreader as defined in claim 7 wherein said head assembly has a pair of spaced-apart header plates rigidly connected thereto, said spreader means including a pair of vertically-extending spreader bars positioned between said header plates and each having anchor-engaging spreader plates at the lower end thereof.

9. An anchor spreader as defined in claim 8 wherein said head assembly has a hydraulic cylinder movably connecting each spreader bar to the respective header plate whereby the hydraulic cylinders can move the spreader bars toward the header plates and the spreader plates to spread the anchors.

10. An anchor spreader as defined in claim 7 wherein said rail clamp assemblies have means defining a plurality of rail engaging surfaces for providing frictional resistance forces along a rail lateral face and a rail top face.

11. An anchor spreader as defined in claim 10 wherein said means defining rail engaging surfaces for providing a frictional resistance force along a rail lateral face include a rotatable clamp pivoted to said rail clamp assembly.

12. An anchor spreader as defined in claim 10 wherein said means defining rail engaging surfaces for providing a frictional resistance force along a rail top face include an elongate pad positionable above the rail.

13. An anchor spreader as defined in claim 12 wherein said pad has an arcuate recess for frictionally engaging the top of a rail when the head assembly is lowered.

14. An anchor spreader as defined in claim 7 wherein said rail clamp assemblies have a plurality of vertically depending hydraulic cylinders each pivotally interconnecting the head assembly at one end thereof and a rotatable clamp at an opposite end thereof whereby activation of the hydraulic cylinders rotates the clamps into engagement with the rail.

15. An anchor spreader as defined in claim 7 including a hydraulic cylinder interposed between the frame and the head assembly for driving the head assembly vertically toward and away from a tie and between the raised inoperative position and the lowered operative position.

16. An anchor spreader for moving anchors along a rail supported on an upper face of a number of transverse ties, with the ties being removably disposed beneath the rail and the anchors having a first portion extending above the upper face, and a second portion extending below the upper face, the anchor spreader comprising:

a vehicle movable along a pair of rails and having a frame overlying the rails, the frame having a pair of spaced-apart head guide members;

a head assembly having a pair of vertically-disposed header plates positioned therebetween and means movably mounting the head assembly to the head guide members whereby the vehicle can be positioned to align the head assembly with one of said ties and the head assembly lowered to a position closely overlying the tie;

a pair of spreader means mounted on the head assembly each comprising a pair of spreader bears each having at least one spreader plate at the lower end for engaging the first portion of a rail anchor, the spreader plates engaging the second portion of a rail anchor after one of said ties is removed;

means for moving the spreader bars of each pair thereof in opposite directions to move pairs of rail anchors associated with each rail away from the tie; and rail-engaging clamping means for holding the head assembly against movement longitudinally of the rails as said pairs of rail anchors are forced to move lengthwise of the rails.

17. An anchor spreader as defined in claim 16 wherein the head assembly has a pair of spaced apart header plates rigidly interconnecting with a plurality of head rods, and means movably mounting said spreader bars on said head rods.

18. An anchor spreader as defined in claim 17 wherein said means for moving said spreader bars in opposite directions comprise a hydraulic cylinder with said hydraulic cylinder and an associated piston interconnecting each header plate and spreader bar.

19. An anchor spreader as defined in claim 16 including means for adjustably mounting the rail clamping means on the head assembly for setting a lowered position of the head assembly to accommodate variations in the height of rails with which the anchor spreader is used.

20. The anchor spreader defined in claim 16 wherein the head assembly is elevated toward an inoperative position prior to moving the vehicle along the rails, and including position sensing means on the frame for detecting a sufficiently elevated position of the head assembly prior to moving the vehicle along the rails.

21. The anchor spreader defined in claim 16 including limit means for limiting the travel of the spreader bars when the spreader bars are moved in opposite directions to move the pairs of rail anchors associated with each rail away from the tie.

* * * * *